US006361130B1

(12) United States Patent
Kardy

(10) Patent No.: US 6,361,130 B1
(45) Date of Patent: Mar. 26, 2002

(54) STORAGE CABINET

(76) Inventor: Ellen Kardy, 3612 Legation St. NW., Washington, DC (US) 20015

( * ) Notice: Subject to any disclaimer, the term of this patent is extended or adjusted under 35 U.S.C. 154(b) by 0 days.

(21) Appl. No.: 09/285,787

(22) Filed: Apr. 5, 1999

(51) Int. Cl.[7] ..... A47B 67/02
(52) U.S. Cl. ..... 312/245; 312/291; 211/85.2
(58) Field of Search ..... 312/204, 242, 312/245, 246, 248, 291, 351, 138.1; 206/565, 566, 6.1, 493; 211/85.2

(56) References Cited

U.S. PATENT DOCUMENTS

| | | | | | |
|---|---|---|---|---|---|
| 949,485 | A | * | 2/1910 | Karay | 312/DIG. 33 |
| 1,006,481 | A | * | 10/1911 | Johnson et al. | 312/242 X |
| 2,950,003 | A | * | 8/1960 | Simmons et al. | 206/565 |
| 3,930,702 | A | * | 1/1976 | Pichowicz | 312/245 |
| 4,324,446 | A | * | 4/1982 | LeSage | 312/245 |
| 4,776,650 | A | * | 10/1988 | Ferenzi | 312/245 |
| 4,978,001 | A | * | 12/1990 | Nelson | 312/248 X |
| 5,242,048 | A | * | 9/1993 | Ellingsworth et al. | 206/6.1 |
| 5,551,772 | A | * | 9/1996 | Keffer | 206/6.1 X |

FOREIGN PATENT DOCUMENTS

| | | | | |
|---|---|---|---|---|
| CA | 494936 | * | 7/1953 | 312/138.1 |

* cited by examiner

*Primary Examiner*—Janet M. Wilkens
(74) *Attorney, Agent, or Firm*—Finnegan, Henderson, Farabow, Garrett & Dunner, L.L.P.

(57) ABSTRACT

A storage cabinet, comprises a first frame for mounting on a wall structure; a second frame hinged for movement with respect to the first frame; a plurality of transverse members arranged in the first and second frames; a plurality of hooks, pins or the like, mounted to the transverse members for supporting a stored item, such as jewelry; a separation membrane hinged for movement with respect to the first and second frames for segregating the stored item supported by the supporting member of the first frame from the stored item supported by the supporting member of the second frame; and a cover member mounted on the second frame. The separation membrane may be a transparent member, such as a flexible plastic sheet, for facilitating visual observation of the stored item. The first and second frames may each have a narrow profile sized for mounting on a wall of a building structure in the space formed between the wall and a fully-opened door of the building structure without substantially interfering with the movement of the door.

11 Claims, 4 Drawing Sheets

STORAGE CABINET

BACKGROUND OF THE INVENTION

1. Field of the Invention

The present invention relates to storage cabinets for storing an item, such as jewelry, fishing tackle, and the like. More particularly, the invention relates to storage cabinets for hanging-type jewelry, fishing tackle, and any other things that get tangled easily while being stored.

2. Description of the Prior Art

Those who own or maintain large amounts of, for example, jewelry, such as necklaces and other items which hang on the person, frequently face the problem of how to efficiently store such jewelry so that it can be segregated for easy access, and can be readily viewed during storage. In addition, it is desirable that any storage cabinet for such jewelry be as compact as possible taking up a minimum of space, while maintaining the flexibility to store other types of non-hanging jewelry, such as earrings, bracelets, and the like.

Several attempts to solve this problem have been proposed in the prior art. For example, U.S. Pat. No. 4,776,650 to Ferenzi describes a wall mounted cosmetic center which includes a plurality of cosmetic supporting shelves, and a series of holders on the rear of the doors of the cosmetic center, for storing jewelry. Nelson, U.S. Pat. No. 4,978,001, discloses a jewelry cabinet having three hinged boxes with hinged panels there within. Curtains are shown as separating the jewelry in each box. U.S. Pat. No. 4,324,446 to Le Sage describes a portable jewelry cabinet having a pair of hinged covers separated from the back by a pair of inner closure members. While the above described devices, and others appear to have utility in providing for the storage of jewelry, none of these devices appears to have been entirely satisfactory in providing for easy storage and retrieval of a variety of jewelry, while maintaining a compact size and decorative appearance.

SUMMARY OF THE INVENTION

Accordingly, it is an object of the present invention to allow for the easy storage and retrieval of stored items, including hanging type jewelry, fishing tackle, and any other things that get tangled easily while being stored. It is a further object of the invention to reduce the profile of a storage cabinet so as to occupy a minimum of space. Another object of the invention is to improve the outer appearance of a storage cabinet.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the storage cabinet of this invention comprises a first generally rectangular frame for mounting on a wall structure; a second generally rectangular frame hinged for movement with respect to the first frame; and a plurality of transverse members arranged in the first and second frames. The invention also includes supporting means provided to the transverse members for supporting a stored item; and separation means hinged for movement with respect to the first and second frames for segregating the stored item supported by the supporting means of the first frame from the stored item supported by the supporting means of the second frame. The separation means is a flexible sheet for allowing the stored item in one of the first and second frames to intrude into the other of the first and second frames when the first and second frames are closed.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
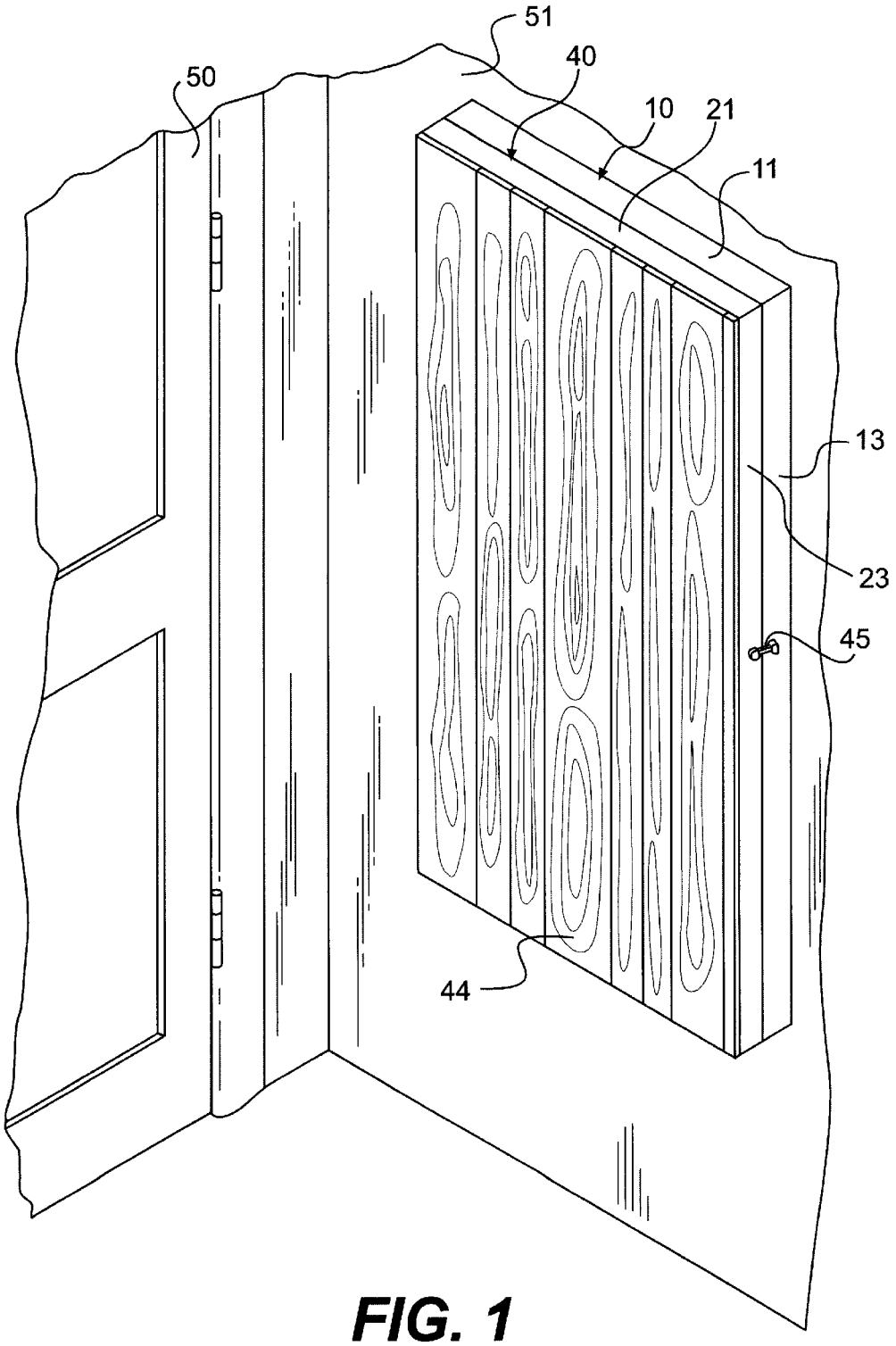
FIG. 1 is a perspective view of a cabinet according to the present invention.
Figure 2:
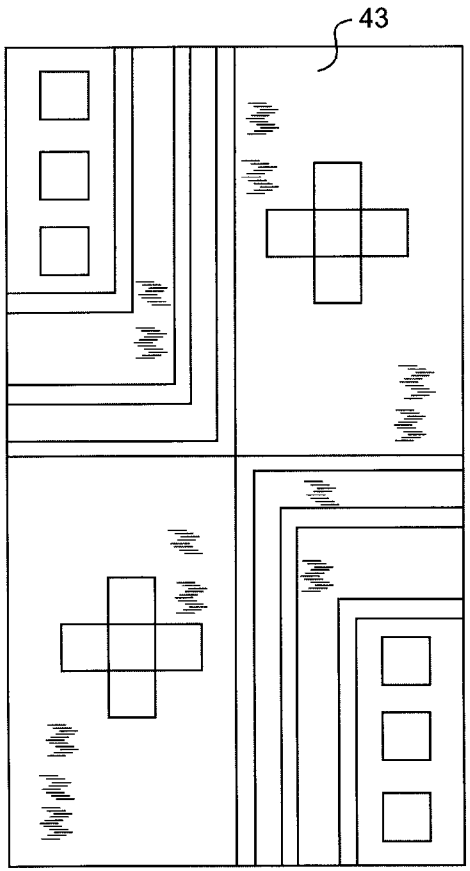
FIG. 2 is an external front view of the cabinet of the invention showing the use of a decorative fabric as the cover member.
Figure 4:
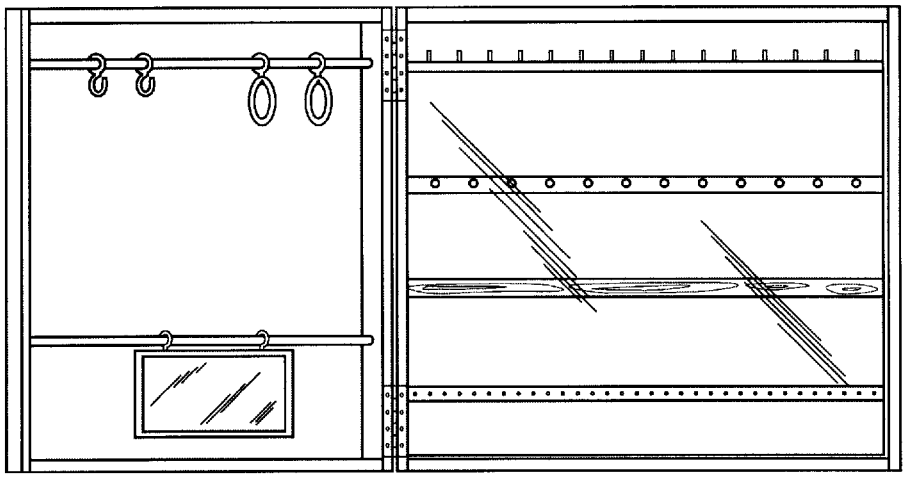
FIG. 4 is a front view of another embodiment of the invention, in the open condition similar to FIG. 3.

In accordance with the invention, the storage cabinet of the present invention includes a first frame for mounting on a wall structure, and a second frame hinged for movement with respect to the first frame. As shown in FIGS. 1 and 2, a first frame 10 forms an elongated rectangle, and includes top and bottom members 11, 12, and side members 13. The top and bottom members 11, 12 are joined to the side members 13 at their respective ends to form the first rectangular frame 10. The first frame 10 is mounted to a wall of a building 51 by using suitable fasteners, such as screws, nails, or the like (not shown). A second frame 20, similar in size and shape to the first frame, is hingedly connected to the first frame on one side thereof for door-like movement with respect to the first frame 10. A pair of hinges 24 provide the mechanism for this connection, or a single hinge could be used.

In accordance with the invention, a plurality of transverse members arranged in the first and second frames. As embodied herein, a plurality of transverse members 16 are disposed laterally across the first frame 10 between the side members 13, and are fastened to the side members 13 using suitable fasteners or glue (not shown). The transverse members 16 may be in the form of dowels of varying sizes, bars, rods or lath-sized strips of wood or other material. A similar set of transverse members 26 are disposed across the second frame 20. The transverse members also could be fastened to the back of the frame, or could be integrally formed as a part of a molded unitary structure.

Figure 3:
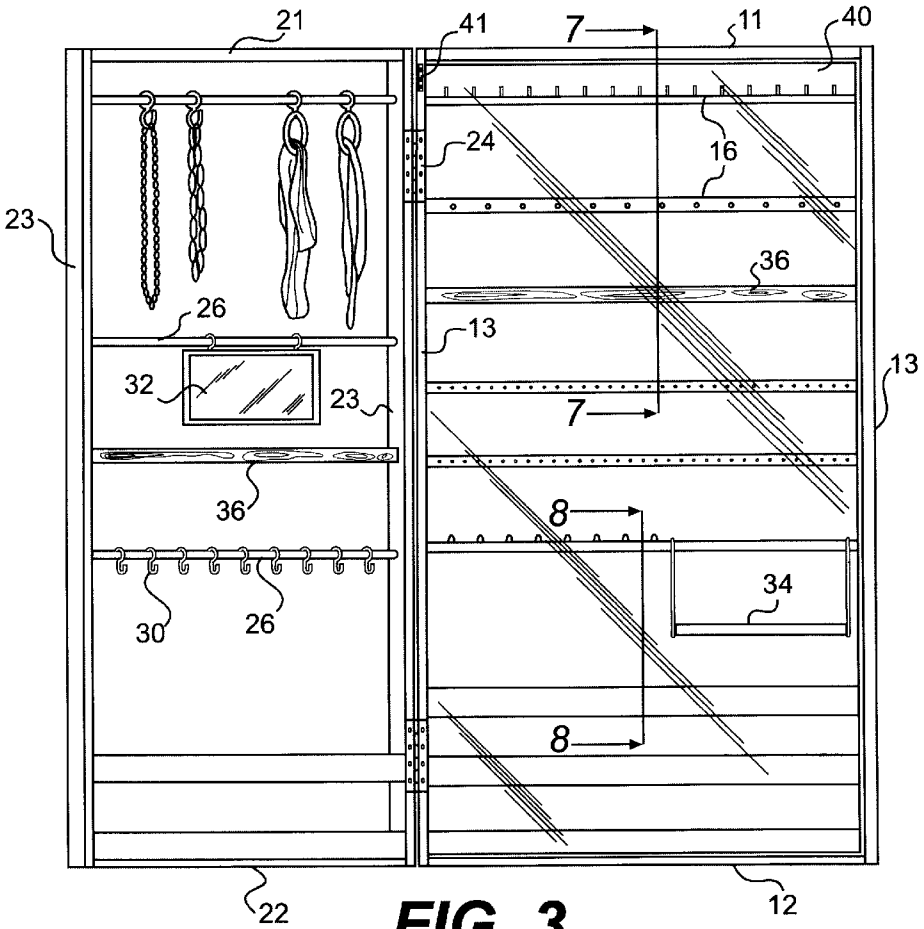
FIG. 3 is a front view of the cabinet of the invention in an open condition.

In accordance with the invention, supporting means are provided to the transverse members for supporting a stored item, such as jewelry, fishing tackle, or the like. As embodied herein, the supporting means may include at least one of holes, dowels, pins, rods, and hooks. As shown in FIG. 3 a plurality of hooks 30 are suspended from the transverse members 16, 26 for attaching necklaces, bracelets, etc. In addition, a small mirror 32 may be attached to one of the transverse members 16, 26 to facilitate viewing of the jewelry on a wearer.

It is preferred that shelf means be mounted to the transverse members for supporting items of jewelry or other objects which are not easily hung from the transverse members. In the illustrated embodiment, one or more small shelves 34 are suspended from the transverse members 16, 26. These shelves 34 can be used to support small items of jewelry which cannot easily be attached to the hooks, such as earrings, pins, etc. Trays or bins may also be used. Pieces of soft materials 36, such as cardboard, Styrofoam, or any other suitable material, may be attached to the transverse members 16, 26 for holding earrings, pins or other items having pin-like appendages. The pin portions can easily penetrate the soft material and hold the item in place. For earrings, slots in a wood, plastic, metal, cardboard or other reinforced paper product allow the posts of the earrings to be held in the slots between the decorative portion of the earring and the back clasp of the earring. In addition, vertical posts may be provided for holding rings and the like.

Figure 5:
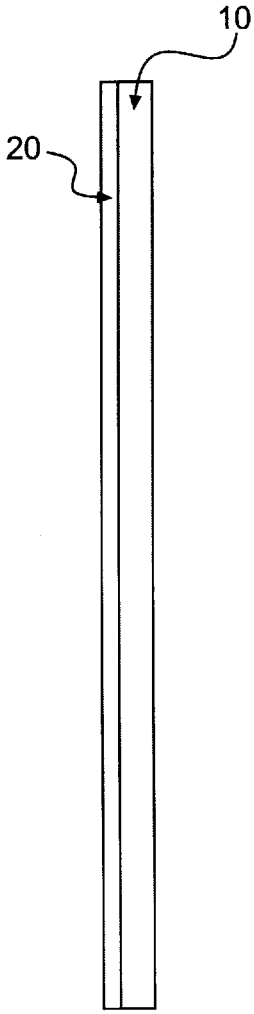
FIG. 5 is a side view showing an alternative embodiment of the invention with a narrower profile.
Figure 6:
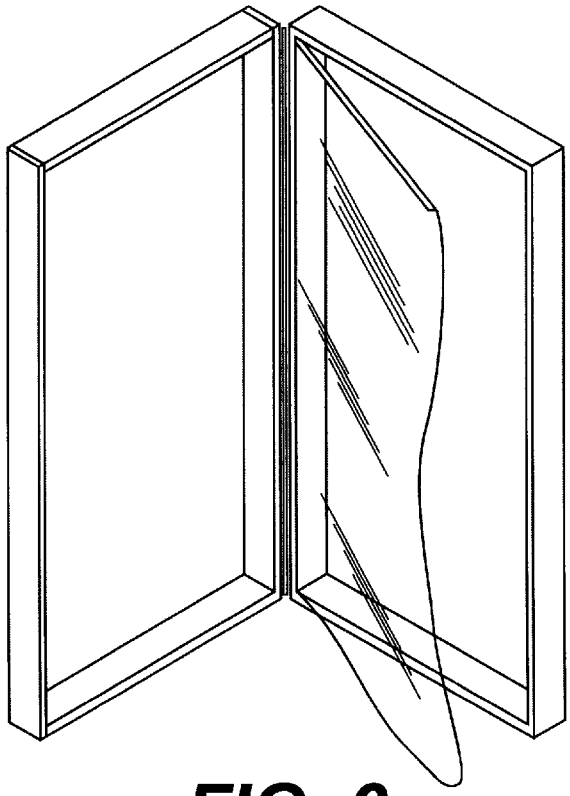
FIG. 6 is a perspective view showing the basic framework of the cabinet of the invention.
Figure 8:
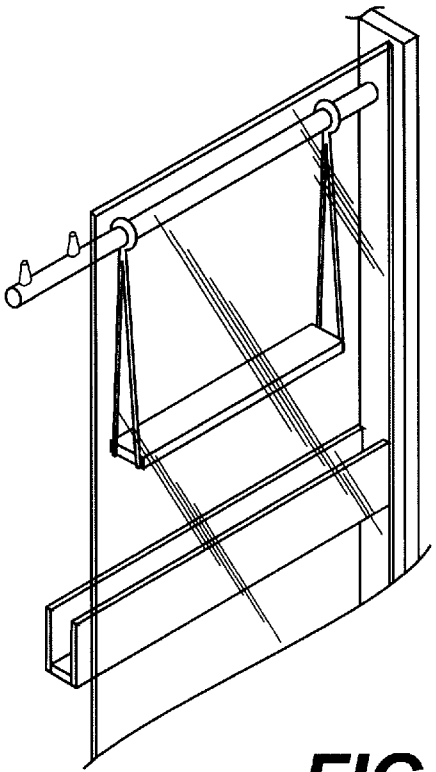
FIG. 8 is another partial cut-away view of the inside of the cabinet.
Figure 7:
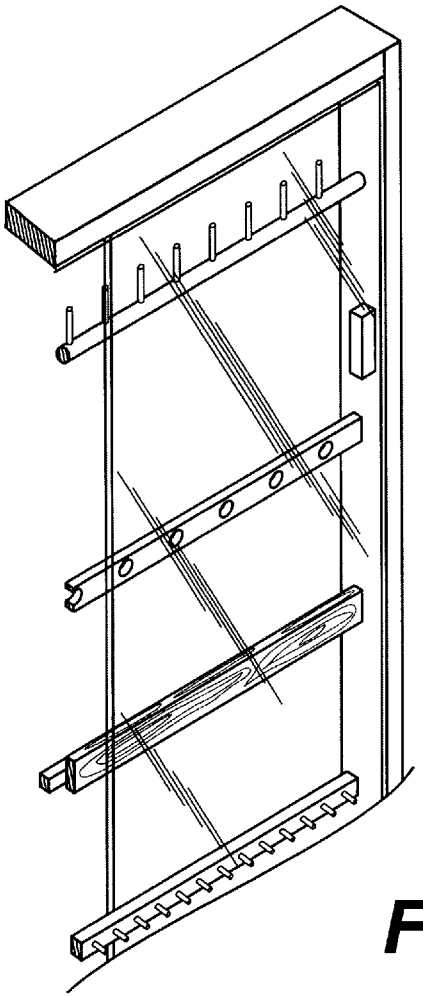
FIG. 7 is a partial cut-away view of the inner part of the cabinet of the invention.

The transverse members 16, 26 may be mounted to the frames with varying distances between adjacent transverse members. As shown in FIG. 3, some of the transverse members 16, 26 are closer to each other for holding non-hanging jewelry, and the remaining transverse members 16, 26 are spaced further apart for accommodating hanging jewelry, such as chains, necklaces, etc. In addition, the second frame 20 may be made thinner than the first frame 10. For example, as shown in FIG. 5, the second frame 20 has the same height and width as the first frame 10, but one-half the thickness of the first frame 10. This allows the cabinet to have a narrower profile, while still providing a significant amount of space for jewelry storage. In accordance with the invention, separation means are hinged for movement with respect to the first and second frames for segregating the stored item supported by the supporting means of the first frame from the stored item supported by the supporting means of the second frame.

In the illustrated embodiments, the separation means includes a transparent member for facilitating visual observation of the stored item, such as jewelry. As shown in FIG. 3, a transparent sheet 40 is mounted to one side 13 of the first frame 10 by a hinge 41. This allows the sheet 40 to be moved on the hinges 41 away from and toward the first frame 10. The transparent sheet 40 allows the user to see the jewelry hanging on the first frame 10, and also serves to separate the jewelry on the first frame 10 from the jewelry on the second frame 20. The transparent sheet 40 also allows the jewelry in one of the first and second frames to intrude into the other of the first and second frames when the suitable first and second frames are closed. The transparent sheet 40, moreover, may be made of a soft material to protect the jewelry by providing cushioning. This construction of the transparent sheet 40 prevents the jewelry pieces from rubbing against each other and avoids frustrating and time-consuming entanglements of the jewelry which would occur in the absence of the transparent sheet 40. The transparent sheet 40, furthermore, contributes to reduction in the size of the cabinet. The transparent sheet may be formed of any suitable material, for example, flexible plastic sheet.

In accordance with the invention, the cabinet includes a cover member mounted on the second frame. In a preferred embodiment, as shown in FIG. 2, the cover member includes a decorative fabric 43. The fabric 43 may have a colorful pattern printed thereon, so that the cabinet appears from the outside as an artistic or decorative piece of furniture. The use of a fabric 43, by itself, as the outer cover can help to maintain a lightweight structure of the overall cabinet. In an alternative embodiment, shown in FIG. 1, the cover is a door or wood panel 44. Instead of a fabric, heavy paper could be used. Also, the cabinet could be an enclosed box covered with fabric, paper, paint, or wood veneer for decoration to match the wall on which the cabinet is mounted. A suitable catch 45 may also be provided for holding the frames together when the cabinet is in a closed position. A lock or hasp (not shown) may be added for security.

It is preferred that the first and second frames each has a narrow profile sized for mounting on a wall of a building structure in the space formed between the wall and a fully-opened door of the building structure without substantially interfering with the movement of the door. As shown in FIG. 1, the frames 10, 20 fit well within the space between an open door 50 of a building structure, and the building wall 51. This allows the door 50 to be fully opened without interfering with or damaging the cabinet mounted to the wall 51 of the building just behind the open door 50. Alternatively, the frames may be sized to fit between the wall studs of a standard wall frame.

The frames and transverse members may be formed of various materials including molded plastic or even cardboard. In the case of cardboard, it is important that the strength be sufficient to support the weight of the jewelry to be stored in the cabinet.

It will be apparent to those skilled in the art that various modifications and variations can be made in the storage cabinet of the present invention without departing from the scope or spirit of the invention. For example, the cabinet could be directly mounted into a wall frame structure so that it was either flush with the external surface of the wall, or recessed within the wall. This would further reduce the space occupied by the cabinet in the building, and would allow for more secure storage, such as a recessed wall safe design. Moreover, the storage cabinet is suitable for storing not only jewelry or fishing tackle but also any items that get tangled easily, such as hair ribbons or belts.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A storage cabinet, comprising:

a first frame for mounting on a wall structure;

a second frame hinged for movement with respect to the first frame;

a plurality of transverse members arranged in the first and second frames;

supporting means provided to the transverse members for supporting stored items;

separation means hinged for movement with respect to the first and second frames for segregating the stored items supported by the supporting means of the first frame from the stored items supported by the supporting means of the second frame, the separation means being a flexible sheet for allowing the stored items in one of the first and second frames to intrude into the other of the first and second frames when the first and second frames are closed.

2. The cabinet of claim 1, wherein the supporting means includes at least one of holes, dowels, pins, rods, slots, pegs and hooks.

3. The cabinet of claim 1, wherein the separation means includes a transparent member for facilitating visual observation of the stored items.

4. The cabinet of claim 3, wherein the transparent member includes thermoplastics.

5. The cabinet of claim 1, also including shelf means mounted to one of the transverse members.

6. The cabinet of claim 1, wherein the first and second frames each has a narrow profile sized for mounting on a wall of a building structure in the space formed between the wall and a fully-opened door of the building structure without substantially interfering with the movement of the door.

7. The cabinet of claim 1, wherein the frames and transverse members are molded plastic.

8. The cabinet of claim 1, further comprising a cover member mounted on the second frame.

9. The cabinet of claim 1, further comprising a cover member mountable over said second frame.

10. The cabinet of claim 9, wherein the cover member includes at least one of decorative fabric, wood paneling, paper and veneer.

11. The cabinet of claim 9, wherein the cover member is a door.

* * * * *